US011957948B2

(12) United States Patent
Küttel

(10) Patent No.: US 11,957,948 B2
(45) Date of Patent: Apr. 16, 2024

(54) UNIVERSAL FITNESS DEVICE

(71) Applicants: Robin Küttel, Weggis (CH); Timo Küttel, Weggis (CH)

(72) Inventor: Robin Küttel, Weggis (CH)

( * ) Notice: Subject to any disclaimer, the term of this patent is extended or adjusted under 35 U.S.C. 154(b) by 83 days.

(21) Appl. No.: 17/315,377

(22) Filed: May 10, 2021

(65) Prior Publication Data

US 2021/0346749 A1 Nov. 11, 2021

(30) Foreign Application Priority Data

May 8, 2020 (AT) ..... A 52/2020

(51) Int. Cl.

| | |
|---|---|
| ***A63B 1/00*** | (2006.01) |
| ***A63B 21/00*** | (2006.01) |
| ***A63B 21/062*** | (2006.01) |
| ***A63B 21/072*** | (2006.01) |
| ***A63B 71/02*** | (2006.01) |

(52) U.S. Cl.

CPC ..... *A63B 21/0628* (2015.10); *A63B 1/00* (2013.01); *A63B 21/00047* (2013.01); *A63B 21/0724* (2013.01); *A63B 2071/025* (2013.01); *A63B 2210/50* (2013.01)

(58) Field of Classification Search

CPC ..... A63B 21/0628; A63B 21/0724; A63B 21/068; A63B 21/078; A63B 71/04; A63B 23/1218; A63B 23/1227; A63B 23/1236; A63B 2023/0411; A63B 1/00–005; A63B 2071/025; A63B 2210/50; A63B 3/00; A63B 9/00

See application file for complete search history.

(56) References Cited

U.S. PATENT DOCUMENTS

| | | | | | |
|---|---|---|---|---|---|
| 715,530 | A | * | 12/1902 | Wallace | A63B 1/00 211/206 |
| D137,646 | S | * | 4/1944 | Stamm | 482/38 |
| 2,817,522 | A | * | 12/1957 | Margulies | A63B 17/00 482/145 |
| 3,598,405 | A | * | 8/1971 | Burns | A63B 21/4029 482/145 |
| D295,809 | S | * | 5/1988 | Green | D6/552 |
| 5,290,209 | A | * | 3/1994 | Wilkinson | A63B 21/00047 482/141 |

(Continued)

OTHER PUBLICATIONS

Machine translation of European Search Opinion for Foreign Application No. 21152160.4, published as EP 4 029 573 A1, completed Jul. 7, 2021, 7 pages (Year: 2021).*

*Primary Examiner* — Joshua Lee
*Assistant Examiner* — Kathleen M Fisk
(74) *Attorney, Agent, or Firm* — Howard & Howard Attorneys PLLC

(57) ABSTRACT

A fitness device (100) for the practice of fitness exercises, includes at least two front limbs (1*a*, 1*b*) and with at least two rear limbs (2*a*, 2*b*), which are each connected to one another in an upper end area (oEb) with connecting joints (3*a*, 3*b*) and with at least one connecting or horizontal bar (4), and the fitness device (100) including at least two fixing holders (9*a*, 9*b*), by means of which in each case one of the front limbs (1*a*, 1*b*) is connectable to in each case one of the rear limbs (2*a*, 2*b*) in such a way that a fixed operating position (Bp) of the fitness device (100) is produced at least one predetermined spread angle (Sw) between the front limbs (1*a*, 1*b*) and the rear limbs (2*a*, 2*b*).

11 Claims, 12 Drawing Sheets

(56) References Cited

U.S. PATENT DOCUMENTS

| | | | | |
|---|---|---|---|---|
| D358,623 | S * | 5/1995 | Macasieb | A63B 21/078<br>D21/691 |
| D454,930 | S * | 3/2002 | Novak | D21/691 |
| 7,364,530 | B2 * | 4/2008 | Lopez | A63B 21/00047<br>482/38 |
| 7,658,702 | B1 * | 2/2010 | Harms | A63B 21/4029<br>482/141 |
| 7,736,286 | B2 * | 6/2010 | Panaiotov | A63B 21/0552<br>482/121 |
| 9,114,272 | B2 * | 8/2015 | Fowler | A63B 17/00 |
| 9,421,411 | B2 * | 8/2016 | Stallman | A63B 21/00047 |
| 10,207,142 | B2 * | 2/2019 | Le Nguyen | A63B 23/1218 |
| 10,532,239 | B1 * | 1/2020 | Suarez Monne | A63B 17/04 |
| 10,813,832 | B2 * | 10/2020 | Qiu | A47F 5/103 |
| 10,905,912 | B2 * | 2/2021 | Thomas | A63B 21/00047 |

* cited by examiner

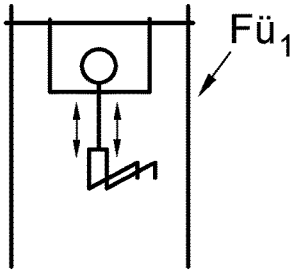
Fig.10a
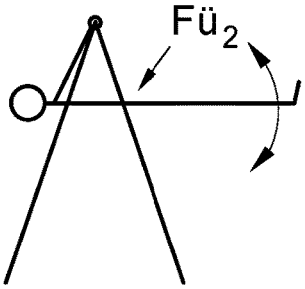
Fig.10b
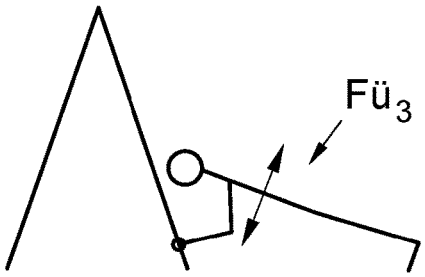
Fig.10c
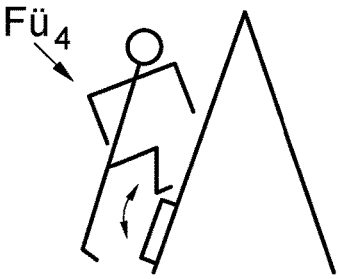
Fig.10d
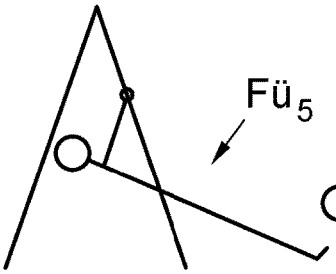
Fig.10e
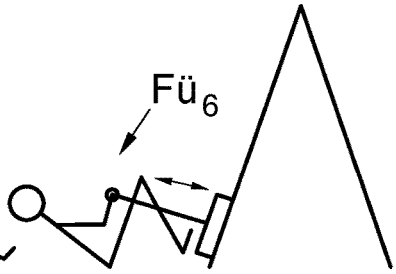
Fig.10f
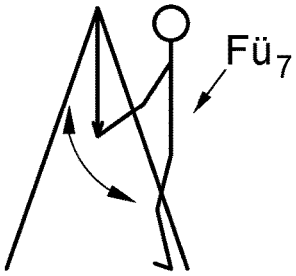
Fig.10g
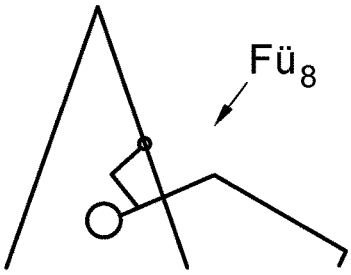
Fig.10h
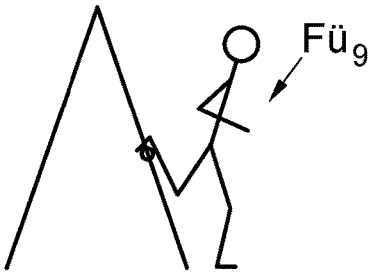
Fig.10i
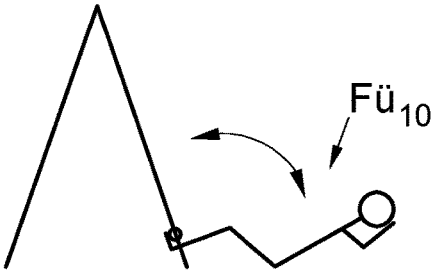
Fig.10j
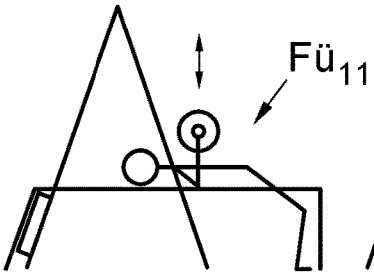
Fig.10k
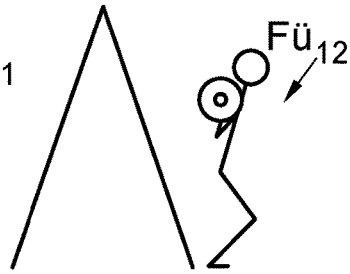
Fig.10l
Fig. 10

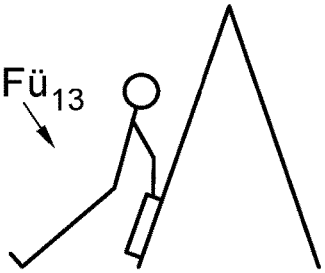
Fig.11a
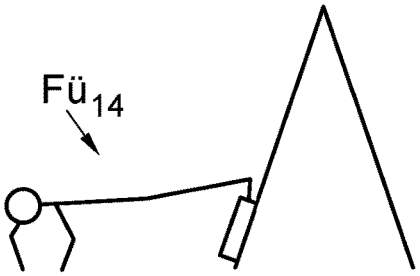
Fig.11b
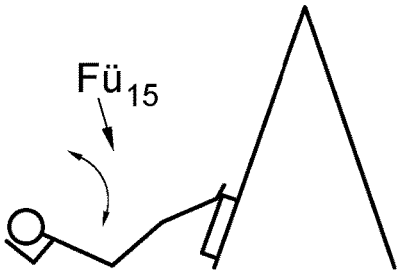
Fig.11c
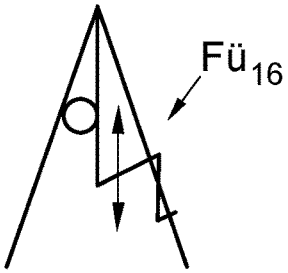
Fig.11d
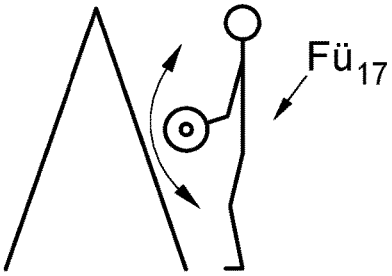
Fig.11e
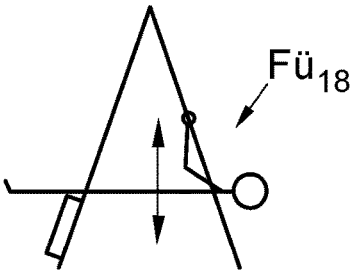
Fig.11f
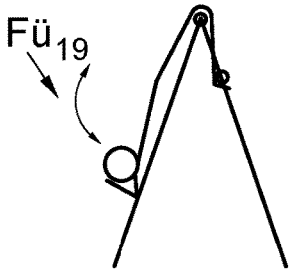
Fig.11g
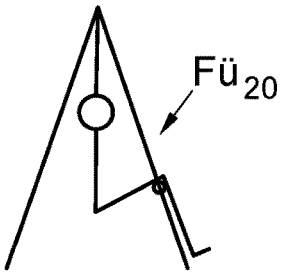
Fig.11h
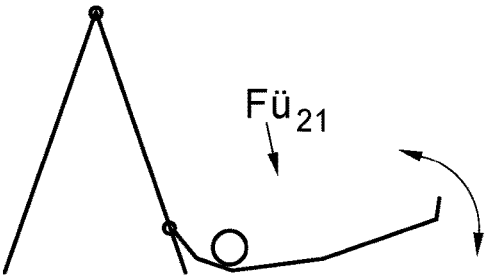
Fig.11i
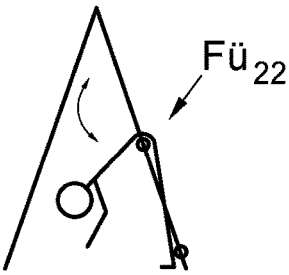
Fig.11j
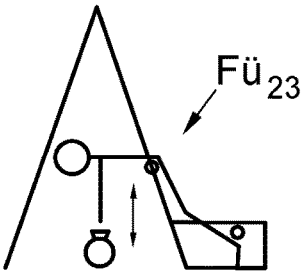
Fig.11k
Fig. 11

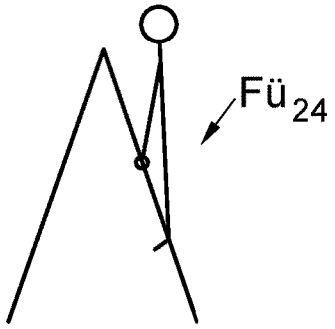
Fig.12a
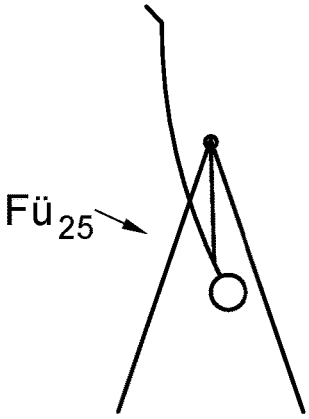
Fig.12b
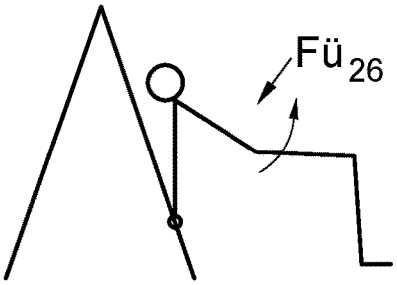
Fig.12c
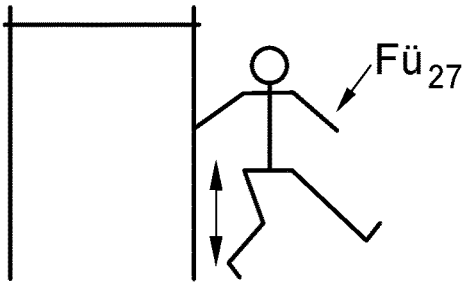
Fig.12d
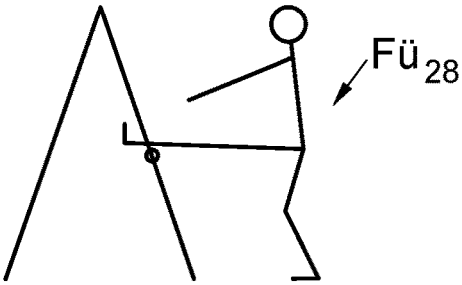
Fig.12e
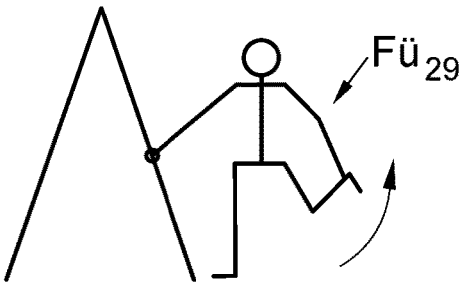
Fig.12f
Fig. 12

UNIVERSAL FITNESS DEVICE

BACKGROUND OF THE INVENTION

The present invention relates to a fitness device that provides a variety of single and full-body fitness exercises primarily for home use, but also in fitness centers.

In the fitness devices manufacturing industry there is an increasing trend towards specialization, towards more and more specific fitness devices that are designed and built for only a few or even only one fitness exercise. This may impress a fitness center customer, if the fitness center offers a variety of different single-specific fitness devices and allows or even professionally designs a fitness program that provides a real circuit from one piece of fitness device to the next, more or less through the fitness center's entire fitness devices inventory.

However, from an overall or economic point of view, such a specialization tendency can run contrary to sustainability ideas. Fitness devices will become more and more specific and are usually massive and heavy iron structures that are expensive and thus, on the one hand, increasingly distancing themselves from applicability in home use, but on the other hand, also from a trend that is becoming more and more fashionable and coming, to live more ecologically and sustainably and to increasingly use only the weight of one's own body for fitness exercises and less auxiliary or assisting fitness devices.

From the point of view of hygiene—not least in times of pandemics and closed fitness centers—it is disadvantageous to have special fitness devices unsuitable for home use, which in fitness centers are usually used by several customers one after the other, again usually without cleaning or even disinfection being provided during the breaks in use between individual customers.

As already mentioned, more complex fitness devices are mostly heavy iron constructions whose mechanics also must to be maintained. Again, from a sustainability point of view, it would be desirable for fitness devices to be made of materials that are more sustainable than iron or plastic.

Simpler fitness devices, which in turn would be suitable for home use, are usually smaller equipments that take up less space, but then also suitable only for one or a few fitness exercises. Training with them can quickly become one-sided and simply boring.

BRIEF SUMMARY OF THE INVENTION

The object of the present invention is to provide an universal fitness device that meets the above criteria in an improved manner. The disadvantages of known fitness devices should be completely or largely eliminated, if possible.

The solution to the problem consists, first of all, in the design and construction of an universal fitness device comprising essentially at least two front limbs and at least two rear limbs, each of which is connected to one another in an upper end area by connecting joints and by at least one connecting or horizontal bar. Furthermore, a minimal variant of an universal fitness device according to the invention comprises at least two fixing holders, each connecting a front limb and a rear limb to each other and thus providing a fixed operating position of the universal fitness device at at least one predetermined spread angle between the front and the rear limbs.

Furthermore, according to an improved and preferred embodiment, a fitness device according to the invention comprises a reinforcement board connecting the at least two rear limbs in a fixing manner and reinforcing the structure, preferably arranged in a lower end area of said rear limbs. This reinforcement board can also serve as a step board and can be formed just as a plain board, but can also have an upper side which is aligned approximately horizontal and can still optionally be formed so wide that a foot length in width can be accommodated thereon and at all a user can also stand comfortably on it.

In addition, optionally and as a basic principle, a connection reinforcing the overall structure can also be provided on the front limbs, for example in the form of a board or strip or holder, in a preferred embodiment, however, a series of bore holes or receptacles are arranged in parallel on the at least two front limbs. In each of these two bore holes or receptacles, preferably at the same height, additional bars can also be inserted in accordance with the invention. These can be solid or hollow and made, for example, of metal or wood. Furthermore, they can have a round cross-section, but also a triangular, quadrangular or hexagonal one. With correspondingly form-fitted receptacles, a rotating or a non-rotating additional bar can so be inserted as desired.

Alone the loose insertion of one or more additional bars into the parallel bore holes or receptacles provides already an additional stabilization for the reinforcement board, but it is still optionally possible to fix the additional bar axially on the front limbs, for example by means of positioning rings, nuts or star rings, or only with spring locks, e.g. called grippers, with which the weights of a barbell are usually fixed axially on the barbell bar.

Still, it is preferred to arrange the connecting or horizontal bar arranged in the upper end area also as just described for the additional bar, so that on the one hand it is axially fixed, but on the other hand, can rotate around its longitudinal axis as required or not.

A preferred embodiment of an universal fitness device according to the invention preferably provides a first connecting joint, for connecting the first front limb together with the first rear limb and with the connecting or horizontal bar, and a second connecting joint for connecting the second front limb with the second rear limb and with the connecting or horizontal bar. These two connecting joints thus form a double joint. For this purpose, on the one hand, fitting bore holes are preferably provided in the upper end area of the front and rear legs, through which the connecting or horizontal bar is guided, and on the other hand, positioning rings are preferably provided, which are still preferably fixable with grub screws.

A further preferred embodiment of an universal fitness device according to the invention moreover provides for a lock. This comprises, for example, at least one radial bore hole in the connecting or horizontal bar as well as correspondingly arranged bore holes in the surrounding material of the upper end area of at least one front or rear limb. Preferably, for example, a split pin or a bolt or locking pin can be inserted into all these bore holes, the latter still preferably with a knob arranged at one end, for better operability, but also so that it cannot fall through the bore holes.

Furthermore, the same types of locks described can also be provided for the additional bars. For this purpose, the described radial bore holes are also provided in the additional bars, and also the corresponding radial bore holes in the surrounding material around the bore holes or receptacles arranged in parallel in the front limbs. Depending on where the additional bar is inserted, the locking pin can then be inserted through the radial bore holes and also removed again. In any case, the described locks ensure that the connecting or horizontal bar and the additional bars can be operated as desired and required, rotating about their longitudinal axis or blocked against rotation.

One still preferred embodiment of an universal fitness device according to the invention provides in the front limbs not only the parallel bore holes or receptacles for the additional bars that can be placed as desired, but also holders or recesses in the material of the front limbs that are preferably repeated in the same order and are also arranged in parallel. A barbell, for example, is suspendable or storable in these holders—viewed in pairs at the same height—more or less at any height.

As already mentioned, an universal fitness device according to the invention already comprises in its minimal version at least two fixing holders, each connecting the front limbs to the rear limbs, preferably arranged in their lower end area. The length of these fixing holders and their attachment provides a certain spread angle between the front and the rear limbs, as well as a certain predetermined operating position of the universal fitness device. However, according to a further embodiment of an universal fitness device still according to the invention, it is also possible to provide different spread angles and different operating positions. For this purpose, the fixing holders are arranged at one of their ends on one of the front or rear limbs by means of a swivel joint. The respective opposite ends of the fixing holders can optionally be fastened at fastening points of different heights, for example and preferably by means of a hand screw in threaded bushes which are recessed or inserted in the material of the limb.

Regarding the material of the limbs and also of the whole universal fitness device, sustainable materials with a better ecological balance are preferred. This can be, for example and preferably, wood, preferably laminated wood and further preferably boiler impregnated. Furthermore, treatment or impregnation of the wood with zinc or copper sulfate or nanosilver or other bacteria-, germ- and virus-killing substances and solutions comes into consideration. Furthermore, varnishes and other coatings that are particularly good and easy to clean or disinfect, or so-called lotus flower varnishes, to which virtually nothing adheres.

According to a further preferred embodiment, an universal fitness device still according to the invention, is foldable from the operating position into a space-saving folding or transport and storage position. For this purpose, the fixing holders are rotatable arranged with the described swivel joints and removable with the likewise described hand screws. When the hand screw is loosened, the fixing holders can be swung out of one or rather their respective mounting position in the swivel joint to such an extent that they are no longer fixed on the opposite limb, but in a stand-by or waiting position on the same limb on which they are arranged by means of the swivel joint. This is preferably done in a threaded bushing and preferably approximately in line with the longitudinal extension of the limb. When both fixing holders have now been loosened and "tidied up", one or more possibly inserted locking pins at the connecting joints can be removed and the front and rear limbs can be folded together. In other words, if, for example, the rear limbs of the universal fitness device are lying flat on the floor, the spread angle of the front limbs, which then project obliquely upwards, can be brought to zero by also coming to lie flat on the floor.

To facilitate this "exercise", if one wants so, optionally and still in accordance with the invention, rollers can be arranged on the back side of the rear legs, for example in their lower end area below the reinforcement board or step board, over which the universal fitness device can be tilted and rolled away.

Also in the lower end area of the rear, but as well on the front limbs are provided feet, which are preferably interchangeable. For example, felt glides come into consideration, but also rubber feet or caps that can cover the profile of the limb in its entire lower area.

As mentioned already, the reinforcing board arranged on the rear legs approximately in the lower end area fulfills the function of reinforcing the structure, but also the function of a step board. Another function according to the invention provides for using it for rowing training. For this purpose, fastenings can be arranged on it or at least one hole through which, for example, a rubber band or so-called Thera band can be passed.

During both stepping and rowing, the universal fitness device would be exposed to lateral forces that could cause it to slide back and forth. For this purpose, it is intended still in accordance with the invention to provide flattenings at the front end faces of the front limbs in their lower end area, with which the front limbs or the universal fitness device can be supported against a wall. Furthermore, the flattening can have a recess which recesses a wall plinth in such a way that the flattening is actually supported on the wall and not on the wall plinth. In addition, a wall attachment, for example in the form of a hook-shaped profile, can be provided as an accessory, into which the universal fitness device can be hung with a form-fitting counter profile.

Concerning further accessories, a particularly complete universal fitness device according to the invention may comprise form-fitted receptacles or rails for receiving a reclining bench, especially for bench presses. Furthermore, form-fitting receptacles or rails can be arranged for a small bench or rather seat board on rollers, whereby the rowing training would no longer be limited to the trunk and the arms, but would also include the legs.

According to a further embodiment, an universal fitness device according to the invention can have a connecting or horizontal bar which is rotatable mounted in the at least two connecting joints as described, but not only by means of the described fitting bore holes, but with low-friction mechanical pivot bearings such as ball or roller bearings. In this way, a good swing is realizable or fitness exercises with rocking motions. Nevertheless, also in this case a mechanical anti-rotation lock can be provided to lock the rotation possibility, as described with a split pin or locking pin, but also with a mechanical ratchet, which is lockable and unlockable and, by the way, can also provide engagement positions corresponding to the operating positions given by the length and the mounting positions of the fixing holders.

The connecting or horizontal bar can also include one or more deflection rollers, for various fitness exercises with weights on a cable pull.

In the final consequence, in favor of the possibility of being able to provide an universal fitness device according to the invention in a space-saving manner despite its advantageously considerable size, in a final embodiment the described recesses or holders for the barbell are not only arranged in the front limbs, but slightly larger recesses are also arranged at the same height in the rear limbs. Thus, a barbell in the universal fitness device can be left even in the collapsed folding or transport position. There is no need to find a separate storage place for the barbell that takes up more space.

The present application discloses a first application procedure of an universal fitness device as disclosed with two front limbs and with two rear limbs connected to each other in two connecting joints and with a connecting or horizontal bar, and with two fixing holders as well, by performing out the following basic procedural steps:

a)—lifting and rolling of the universal fitness device from its storage place to its installation place;

b)—releasing the fixing holders from their waiting or stand-by positions;

c)—folding up of the first front limb from the folding or transport position to the operating position;

d)—fixing of the first front limb by means of the first fixing holder;

e)—folding up the second front limb from the folding or transport position out to the operating position;

f)—fixing the second front limb by means of the second fixing holder;

g)—lifting and setting up of the universal fitness device;

h)—hanging or placing a barbell in two of the parallel holders in the front limbs;

i)—inserting one or more additional bars into each of two of the parallel receptacles in the front limbs;

j)—if desired, securing the additional bar or the additional bars against rotation;

k)—if desired, securing the connecting or horizontal bar against rotation;

l)—performing at least one of the fitness exercises;

m)—finishing of the fitness training;

n)—removing the barbell from its holders;

o)—if necessary and desired, unlocking the connecting or horizontal bar;

p)—if necessary and desired, unlocking the additional bar or additional bars;

q)—if desired, removing the additional bar from its receptacles in the front limbs;

r)—loosening of the first fixing holder from the first front limb;

s)—fixing the first fixing holder in the waiting or stand-by position;

t)—loosening the second fixing holder from the second front limb;

u)—fixing the second fixing holder in the waiting or stand-by position;

v)—grasping the connecting or horizontal bar and tilting it (whereby the front limbs thereby fold by themselves into the folding or transport position) via the rollers on the rear limbs of the universal fitness device from its erected operating position into a position lying on the rear limbs;

w)—lifting and rolling away the universal fitness device from its installation place to its storage place.

An universal fitness device according to the invention brings the following advantages:

It is very suitable for home use, but can also be used well in fitness centers.

Many fitness exercises are possible with it.

It is not specialized for few specific fitness exercises.

It is sustainable, because of the non-specialization, but also because of the choice of materials, weight and value.

It is easy to clean or disinfect and thus increased hygiene requirements are easy accomplishable with it.

It has no small-scale mechanics that require maintenance.

It is not overly large, but still very complete.

Training with it can be very versatile and thus the user will not get bored so quickly.

It is stable and durable.

The connecting or horizontal bar and the additional bar can be rotated or not at will.

A barbell can be stably placed at almost any height.

The surfaces of a universal fitness device according to the invention are impregnated and/or surface-treated.

A universal fitness device according to the invention provides for an operating position and a space-saving folding or transport position.

If provided, it may be stably supported and secured to a wall.

If provided, it may well function also as a swing.

A barbell can remain in the universal fitness device in the space-saving folding or storage position in the holders.

The disclosed different embodiments of an universal fitness device according to the invention are combinable with each other. For example, the design versions with or without a reinforcement or step board are combinable at will and reciprocally with the different design versions of an universal fitness device according to the invention with or without an additional bar or the described locks and holders, and all this in turn with the different design versions of an universal fitness device still according to the invention with or without the described pivotability of the fixing holders. The same applies as desired optionally and reciprocally to the different design versions with or without the ability to be folded from the operating position into a folding or transport position, as well as the design versions with or without rollers or that with or without the described wall attachment.

Further or advantageous embodiments of an universal fitness device according to the invention, form the objects of the dependent claims.

The reference characters list is part of the disclosure.

BRIEF DESCRIPTION OF THE SEVERAL VIEWS OF THE DRAWINGS

The invention will be symbolically explained in more detail and by way of example by means of drawings. The drawings are described in a coherent and comprehensive manner. They provide schematic and exemplified representations and are not true to scale, not even in the relation of the individual components to each other. Identical reference characters indicate the same component, reference characters with different indices indicate functionally identical or similar components.

It shows hereby FIG. 1 a symbolic and exemplary oblique-sided perspective overall view of a first embodiment of an universal fitness device according to the invention, with a front and a rear pair of limbs, which are each connected in a double joint to a connecting bar and wherein, in the front pair of limbs by way of example, a barbell is suspended;

FIGS. 10A-10L a first set of outlined represented possible fitness exercises with an universal fitness device according to the invention;

FIGS. 11A-11K a second set of outlined represented possible fitness exercises with an universal fitness device according to the invention, and FIGS. 12A-12F a third and final set of outlined represented possible fitness exercises using an universal fitness device according to the invention.

DETAILED DESCRIPTION OF THE INVENTION

Figure 1:
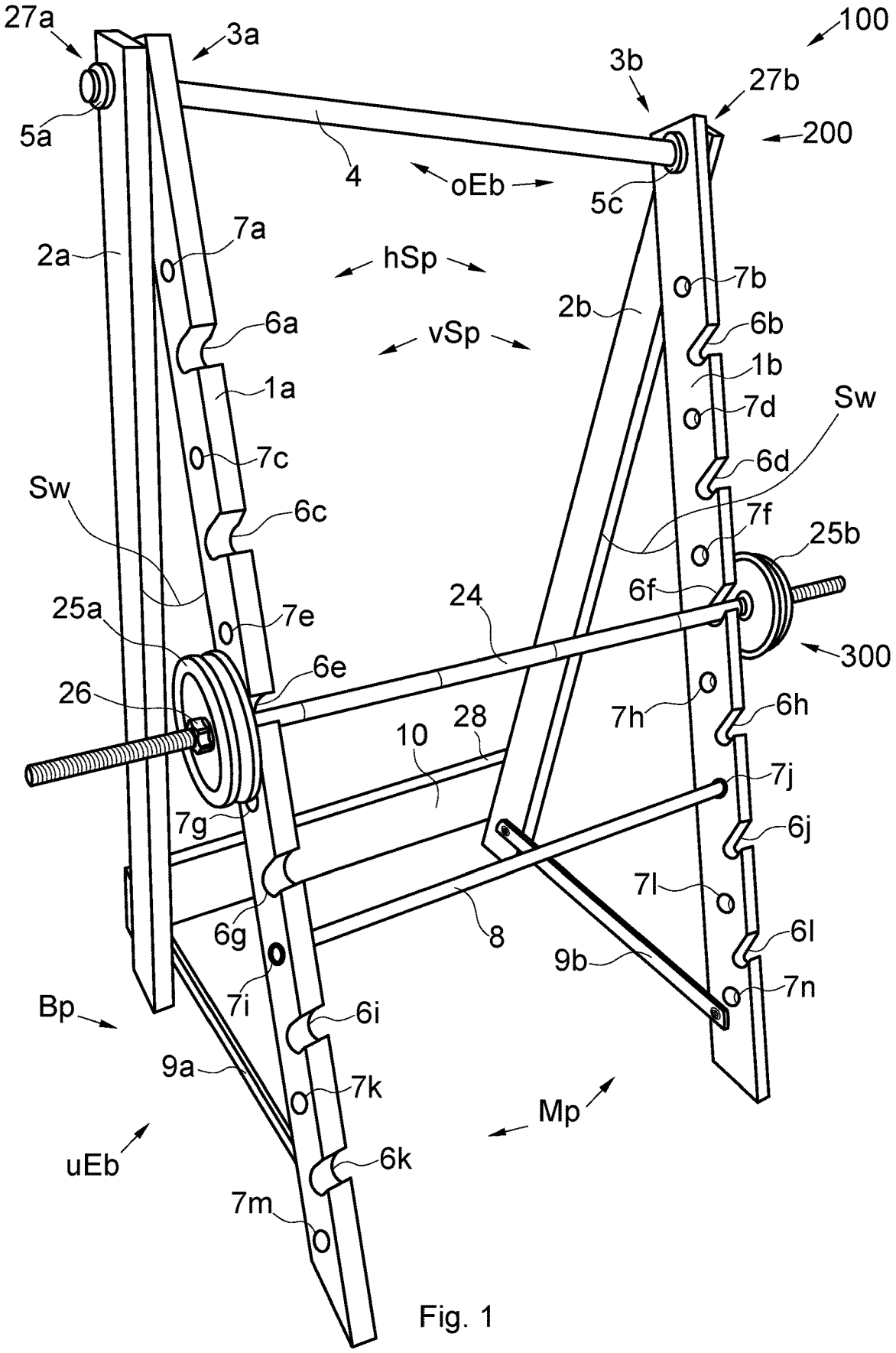

FIG. 1 shows in a symbolic and exemplary as well as perspective overall view, a first embodiment of an universal fitness device 100 according to the invention. A front pair of limbs vSp is formed by a left front limb 1*a* and a right front limb 1*b*, and a rear pair of limbs hSp is formed by a left rear limb 2*a* and a right rear limb 2*b*. The front pair of limbs vSp and the rear pair of limbs hSp are connected by means of a double joint 200 in that a connecting or horizontal bar 4 is passed through merely indicated fitting bore holes 27*a* and 27*b* in an upper end area oEb of the limbs 2*a* and 1*a* as well as 1*b* and 2*b*, thus forming a first, left connecting joint 3*a* and a second, right connecting joint 3*b*. The upper ends of the limbs 2*a* and 1*a* as well as 1*b* and 2*b* are held together by positioning rings 5*a*-5*d* arranged on the connecting or horizontal bar 4, whereby, in this perspective view, only the positioning rings 5*a* and 5*c* are visible.

In the front pair of limbs vSp, holders or recesses 6*a*-6*l* are arranged at regular intervals, for example for a barbell 300, which is suspended by a barbell bar 24, for example in the holders or recesses 6*e* and 6*f*. The barbell 300 furthermore has weights or pairs of weights 25*a* and 25*b*, each of which is fixed by a star ring 26.

Also arranged at regular intervals, but offset from the holders or recesses 6*a*-6*l*, are bore holes or receptacles 7*a*-7*n* in the front limbs 1*a* and 1*b*, which form the front pair of limbs vSp. Additional bars 8, for example, are insertable into these bore holes or receptacles 7*a*-7*n* at any height, as shown by way of example, in the bore holes or receptacles 7*i* and 7*j*.

Similar to a trestle or stepladder, the front limb 1*a* and the rear limb 2*a* as well as the front limb 1*b* and the rear limb 2*b* are each stabilized or fixed against further spreading by a fixing holder 9*a* and 9*b*. Due to a predefined length of the fixing holders 9*a* and 9*b* as well as their fixed arrangement, preferably in a lower end area uEb in a respective mounting position Mp, as illustrated, a predefined operating position Bp of the universal fitness device 100 results, with a likewise predefined spread angle Sw between the front limbs 1*a* or 1*b* and the rear limbs 2*a* or 2*b*, respectively.

Furthermore, is still evidently in this FIG. 1 that a reinforcing board or step board 10 is arranged at the rear side of the rear limbs 2*a* and 2*b*. As already mentioned, it can also be box-shaped and have a large-surface upper side 28, which optionally can also be aligned approximately horizontally.

In the illustrated first embodiment of an universal fitness device 100 according to the invention, the two front limbs 1*a* and 1*b* and the two rear limbs 2*a* and 2*b* are arranged at the top of the connecting joints 3*a* and 3*b* such that the rear limbs 2*a* and 2*b* are on the outside and the front limbs 1*a* and 1*b* are on the inside. This arrangement can also be reversed or mixed, but it is considered advantageous if the somewhat heavier rear limbs 2*a* and 2*b* are arranged on the outside as far as possible and in this way give the universal fitness device 100 a little more stability.

Figure 2:
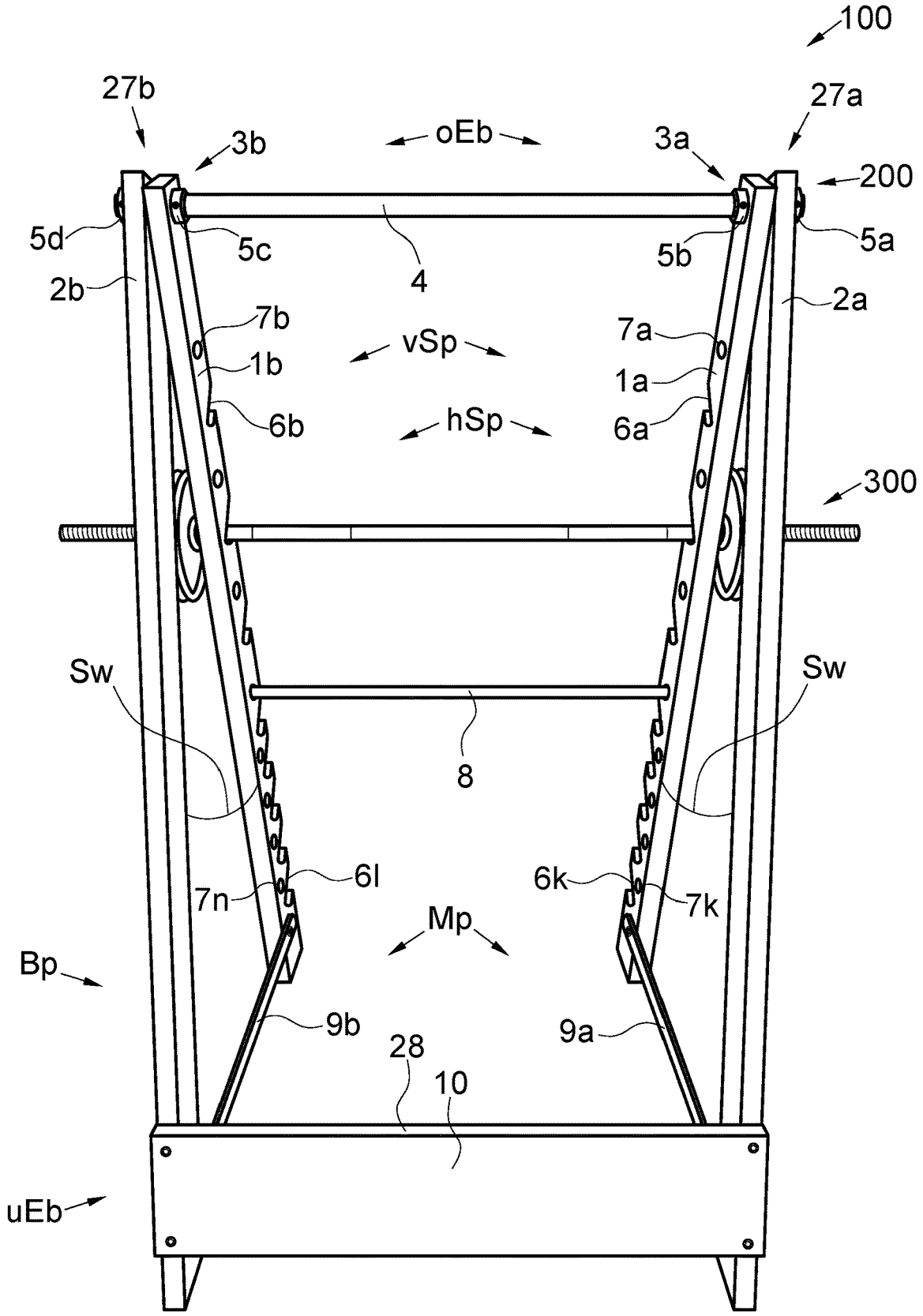
FIG. 2 a symbolic and exemplary rear view of the first embodiment of an universal fitness device according to the invention of FIG. 1.

In FIG. 2, the first embodiment of an universal fitness device 100 according to the invention from FIG. 1 is shown from a straight and rear view. The elements shown are all already known, except for the positioning rings 5*b* and 5*d*, which are now also evident.

Figure 3:
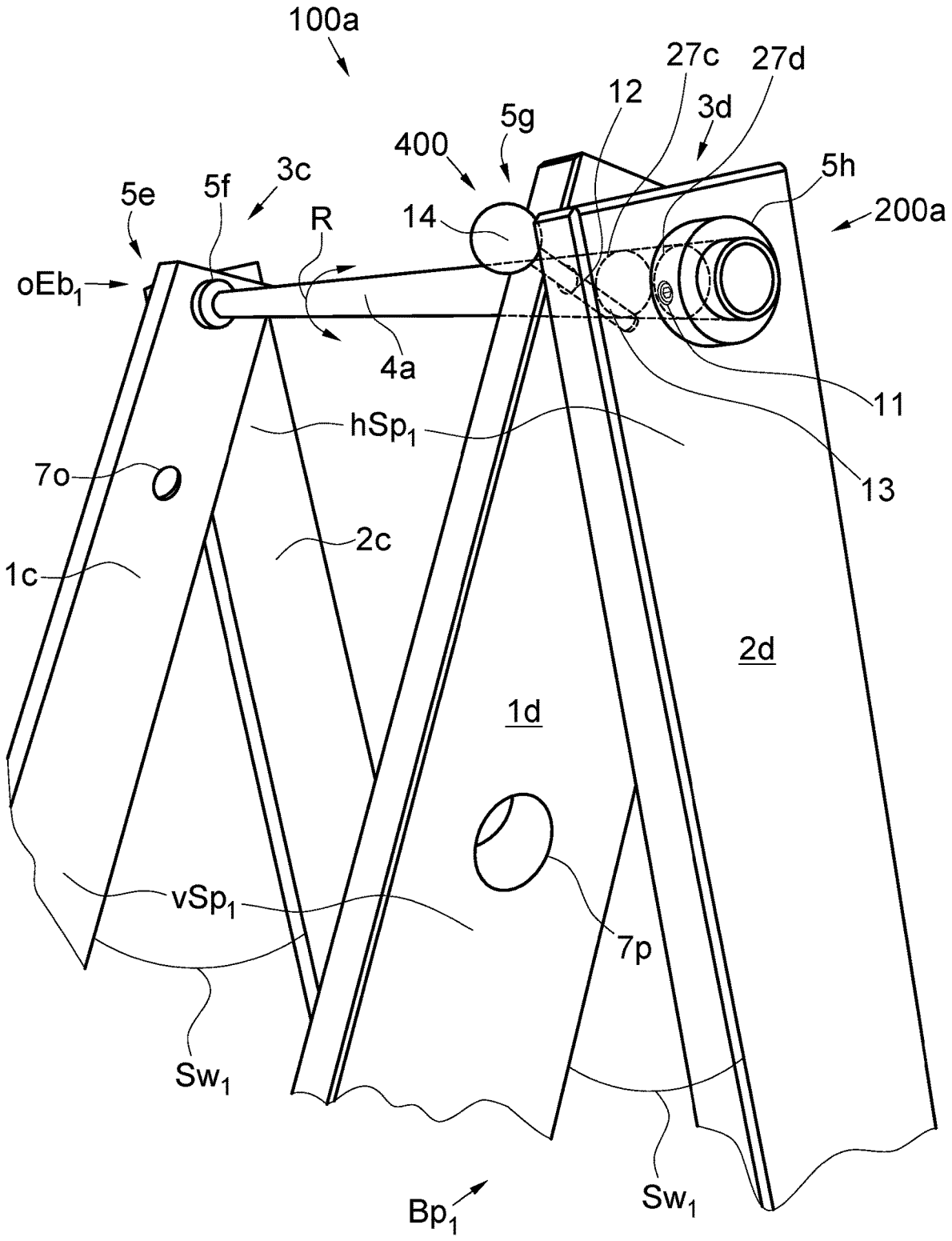
FIG. 3 a symbolic and exemplary detail view of a second embodiment of an universal fitness device according to the invention, with an exemplary locking pin in a joint of the double joint, for locking the connecting bar against rotation.

FIG. 3 shows a second embodiment of an universal fitness device 100*a* according to the invention in a detail view, representing merely an upper end area $oEb_1$ of a first front limb 1*c* and a first rear limb 2*c*, and a second front limb 1*d* and a second rear limb 2*d*. The two first limbs 1*c* and 2*c* are again arranged in a first connecting joint 3*c* by means of a connecting or horizontal bar 4*a*, and the two second limbs 1*d* and 2*d* are correspondingly arranged in a second connecting joint 3*d*. The two connecting joints 3*c* and 3*d* in turn form a double joint 200*a* and the front limbs 1*c* and 1*d* form a front pair of limbs $vSp_1$ and the rear limbs 2*c* and 2*d* form a rear pair of limbs $hSp_1$. The front limbs 1*c* and 1*d* each form a spread angle $Sw_1$ with respect to the rear limbs 2*c* and 2*d*, and this in turn results in an operating position $Bp_1$ of the universal fitness device 100*a*.

Furthermore, is evidently that the first connecting joint 3*c* and the second connecting joint 3*d* are formed in that the limbs 1*c*, 2*c* and 1*d*, 2*d* are fixed to the connecting or horizontal bar 4*a* by means of positioning rings 5*e*-5*h*. The positioning rings 5*e* and 5*g* are merely indicated here by curved arrows, because they are hidden in this view. On the other hand, it is clearly visible that the positioning ring 5*h* is fixed to the connecting or horizontal bar 4*a* by means of a grub screw 11.

Furthermore it is recognizable how the connecting joint 3*d* is constructed, namely the connecting or horizontal bar 4*a* is inserted into a fitting bore hole 27*c* in the front limb 1*d* and simultaneously into a fitting bore hole 27*d* in the rear limb 2*d*. Moreover, in this embodiment of a fitness device 100*a* according to the invention, a lock 400 is implemented in that a bolt or locking pin 13 with a knob 14 is inserted into a radial bore hole 12 in the connecting or horizontal bar 4*a* and into corresponding bore holes, not represented in detail, radially arranged with respect to the fitting bore hole 27*c* in the upper end area $oEb_1$ of the front limb 1*d*. The connecting or horizontal bar 4*a* is in this way secured and can no longer turn in a rotation R.

Furthermore, in this FIG. 3 is still recognizable how bore holes or receptacles 7*o* and 7*p* are arranged, by way of example, in the front limbs 1*c* and 1*d*, for receiving additional bars 8, as shown in the previous FIGS. 1 and 2.

Figure 4:
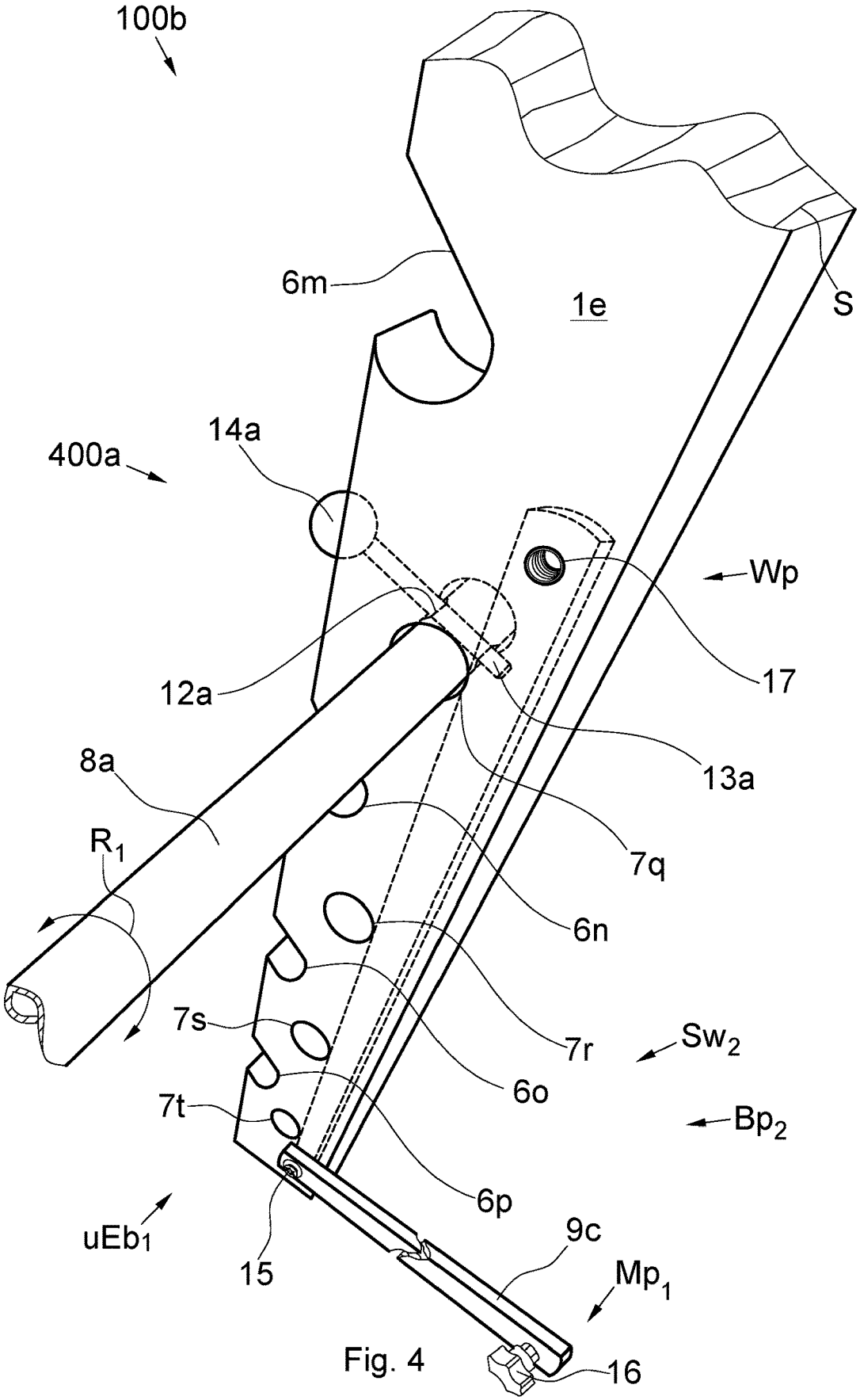
FIG. 4 a symbolic and exemplary detail view of a third embodiment of an universal fitness device according to the invention, with an exemplary locking pin for locking an additional bar against rotation, but also axial displacement.

In FIG. 4, a fourth embodiment of a fitness device 100*b* still according to the invention is shown symbolically and by means of a detail drawing. This embodiment is characterized on the one hand by a lock 400*a*, which this time is provided for securing against radial turn in a rotation $R_1$, but also against axial displacement of an additional bar 8*a*, which is again inserted by way of example in a bore hole or receptacle 7*q* in a front limb 1*e*. The additional bar 8*a* has a radial bore hole 12*a* through which, but also through corresponding bore holes not represented in more detail in the material of the front limb 1*e*, a bolt or locking pin 13*a* with a knob 14*a* is inserted.

Apart from that, the front limb 1*e* has holders 6*m*-6*p* and further bore holes or receptacles 7*r*-7*t* as previously described, for receiving the additional bar 8*a* in a different position or for receiving further additional bars. Incidentally, a hachure S symbolically represents that a preferred material for manufacturing the front limb 1*e* and the universal fitness device 100*b* in general is wood, again preferably laminated wood and still preferably boiler impregnated wood.

Moreover, the front limb 1*e* also has a threaded bushing 17 so that a fixing holder 9*c*, rotatable arranged in a swivel joint 15 preferably in a lower end area $uEb_1$, is pivotable upward so that a hand screw 16 is screwable into the threaded bushing 17. In this way, the fixing holder 9*c* is pivotable from a mounting position $Mp_1$, in which it limits a spread angle $Sw_2$ and an operating position $Bp_2$ of the universal fitness device 100*b*, to a stand-by or waiting position Wp, in which the universal fitness device 100*b* is collapsed as a whole. This will be shown later in FIG. 9.

Figure 5:
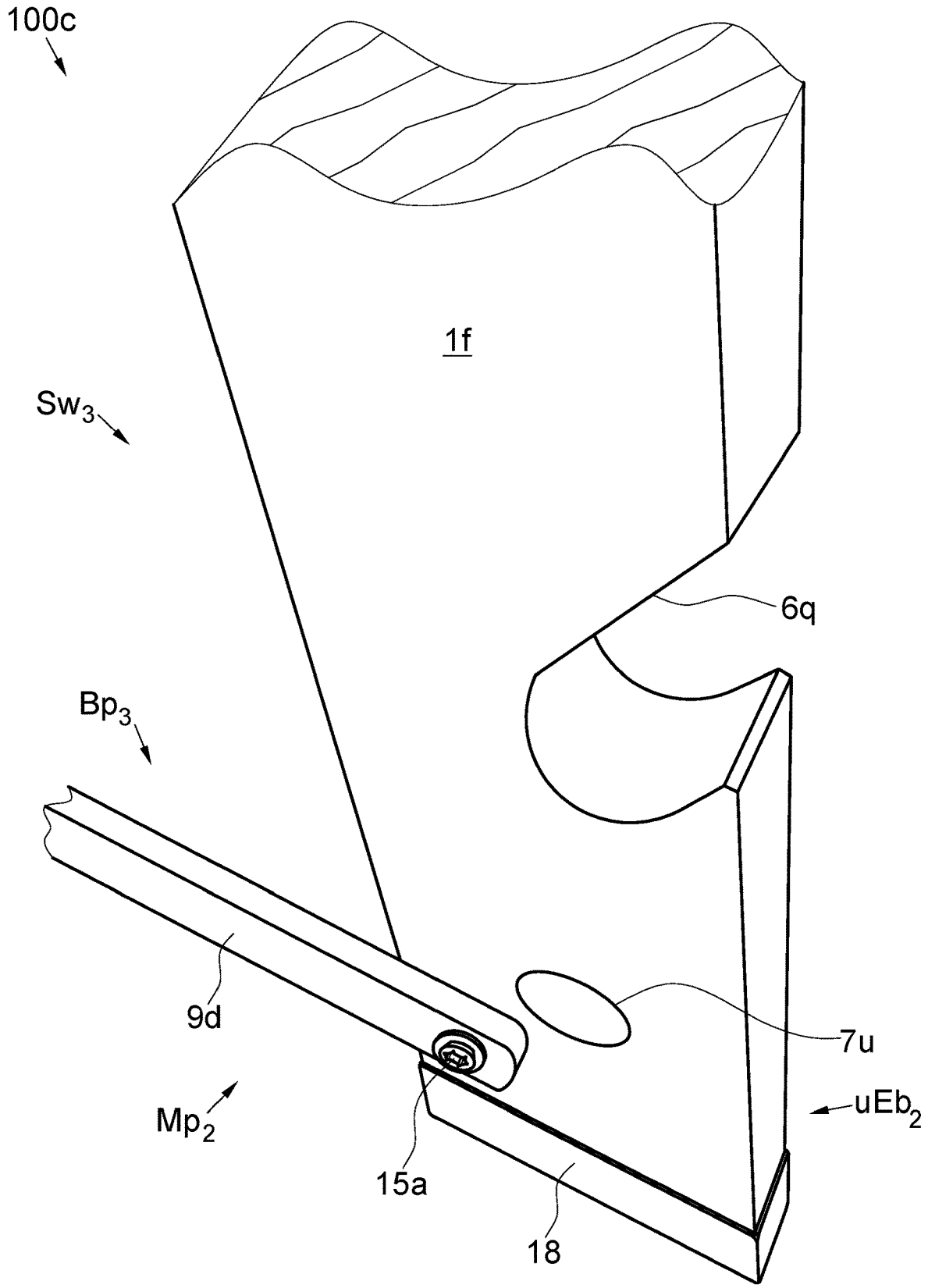
FIG. 5 a symbolic and exemplary detail view of a front limb of a fourth embodiment of an universal fitness device still according to the invention, with a rubber cap arranged on the underside.

FIG. 5 shows, in a merely symbolic detail drawing, a fourth embodiment of an universal fitness device 100*c*, which is still in accordance with the invention and which is characterized in that a rubber cap 18 is arranged, by way of example, in a lower end area $uEb_2$ of a front limb 1*f*.

Apart from that are shown known features, such as a holder or recess 6*q*, a bore hole or receptacle 7*u*, and a fixing holder 9*d* that is pivotable disposed in a swivel joint 15*a*, as in the previous embodiment shown in FIG. 4. The shown position or orientation of the fixing holder 9*d* corresponds to a mounting position $Mp_2$, and this in turn gives a spread angle $Sw_3$ as well as an operating position $Bp_3$ of the universal fitness device 100*c*.

Figure 6:
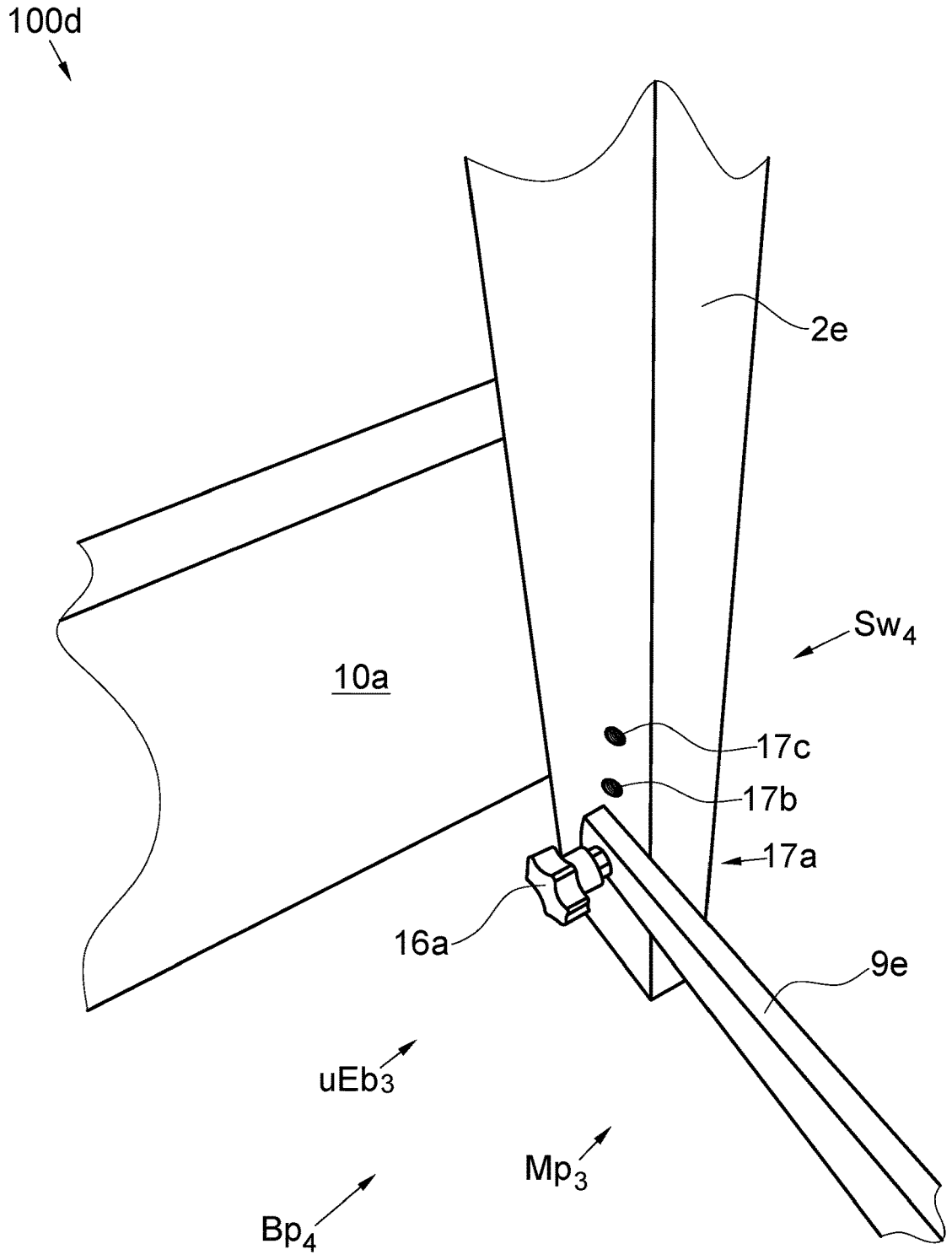
FIG. 6 a symbolic and exemplary detail view of a rear limb of a fifth embodiment of an universal fitness device still according to the invention, with a hand screw for fixing a variable spread angle of the limbs.

In FIG. 6 is merely symbolic and schematic and in a detail drawing represented, a fifth embodiment of a fitness device 100*d*, which is still according to the invention, which is characterized by a variable fixing possibility of the spreading of the limbs. For this purpose, a first threaded bushing 17*a*, which is merely indicated by an arrow, is arranged on a rear limb 2*e*, into which a hand screw 16*a* is screwed and thus a fixing holder 9*e* lock it off in the widest spread position. Above the merely indicated threaded bushing 17*a*, however, further threaded bushings 17*b* and 17*c* are also arranged, which result in less wide spreads. In any case, the shown mounting of the fixing holder 9*e* in a lower end area $uEb_3$ in a mounting position $Mp_3$ in the threaded bushing 17*a* results in a spread angle $Sw_4$, as well as an operating position $Bp_4$ of the universal fitness device 100*d*. The mountings of the fixing holder 9*e* in the threaded bushing 17*b* or 17*c* would each result in slightly different spread angles $Sw_4$ as well as slightly different operating positions $Bp_4$ of the universal fitness device 100*d*.

Figure 7:
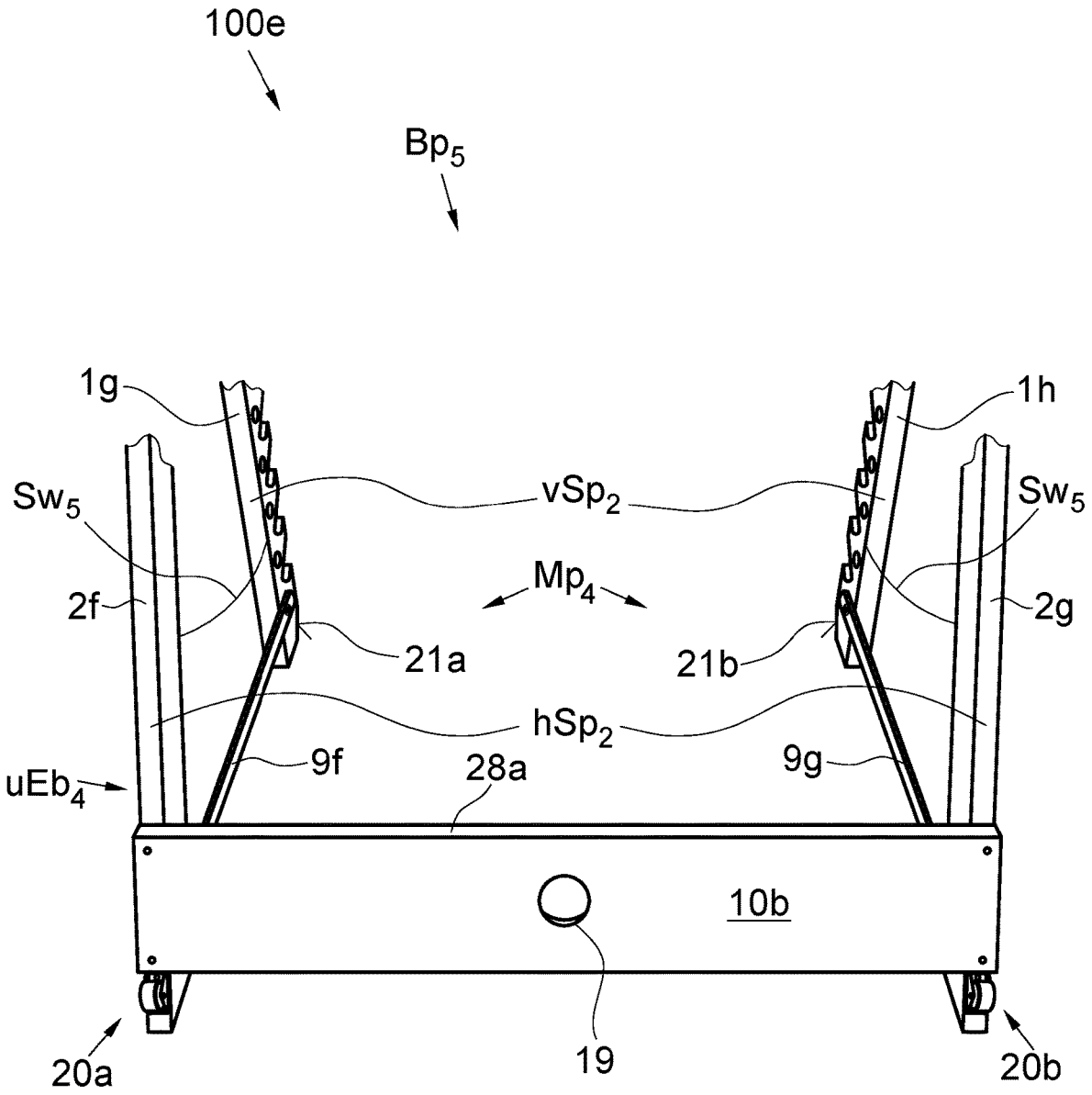
FIG. 7 a symbolic and exemplary detail rear view of a sixth embodiment of an universal fitness device still according to the invention, with exemplary rollers on the rear limbs in each case.

FIG. 7 shows, again in a merely symbolic and exemplary detail view from the rear, a sixth embodiment of an universal fitness device 100*e* still according to the invention. Two rear limbs 2*f* and 2*g* form a rear pair of limbs $hSp_2$ and this is fixed by fixing holders 9*f* and 9*g* in a respective mounting position $Mp_4$ to a front pair of limbs $vSp_2$, which in turn is formed from front limb 1*g* and 1*h*. All this results in an operating position $Bp_5$ of the universal fitness device 100*e* at spread angles $Sw_5$ between the rear limb 2*f* and the front limb 1*g*, and the rear limb 2*g* and the front limb 1*h*. A reinforcement board or step board 10*b* connects the two rear limbs 2*f* and 2*g* in a lower end area $uEb_4$ and optionally has a hole 19 arranged approximately central, for example in order to be able to pass through or tie on a rubber band or so-called Thera-Band. An upper side 28*a* of the reinforcement board or step board 10*b* can again also be formed approximately horizontal and wider.

In addition, but useful just for example for rowing or pulling exercises with the Thera-Band or else also for an improved support position of the universal fitness device 100*e* against a wall, for example during step exercises on or against the step board 10*b*, flattenings 21*a* and 21*b* are provided at the front sides of the front—in this view rear—limbs 1*g* and 1*h*, respectively.

Also optionally arranged in the lower end area $uEb_4$ of the rear, now front, limbs 2*f* and 2*g* are respective rollers 20*a* and 20*b*. These serve the purpose of being able to tilt and roll away the universal fitness device 100*e*.

Figure 8:
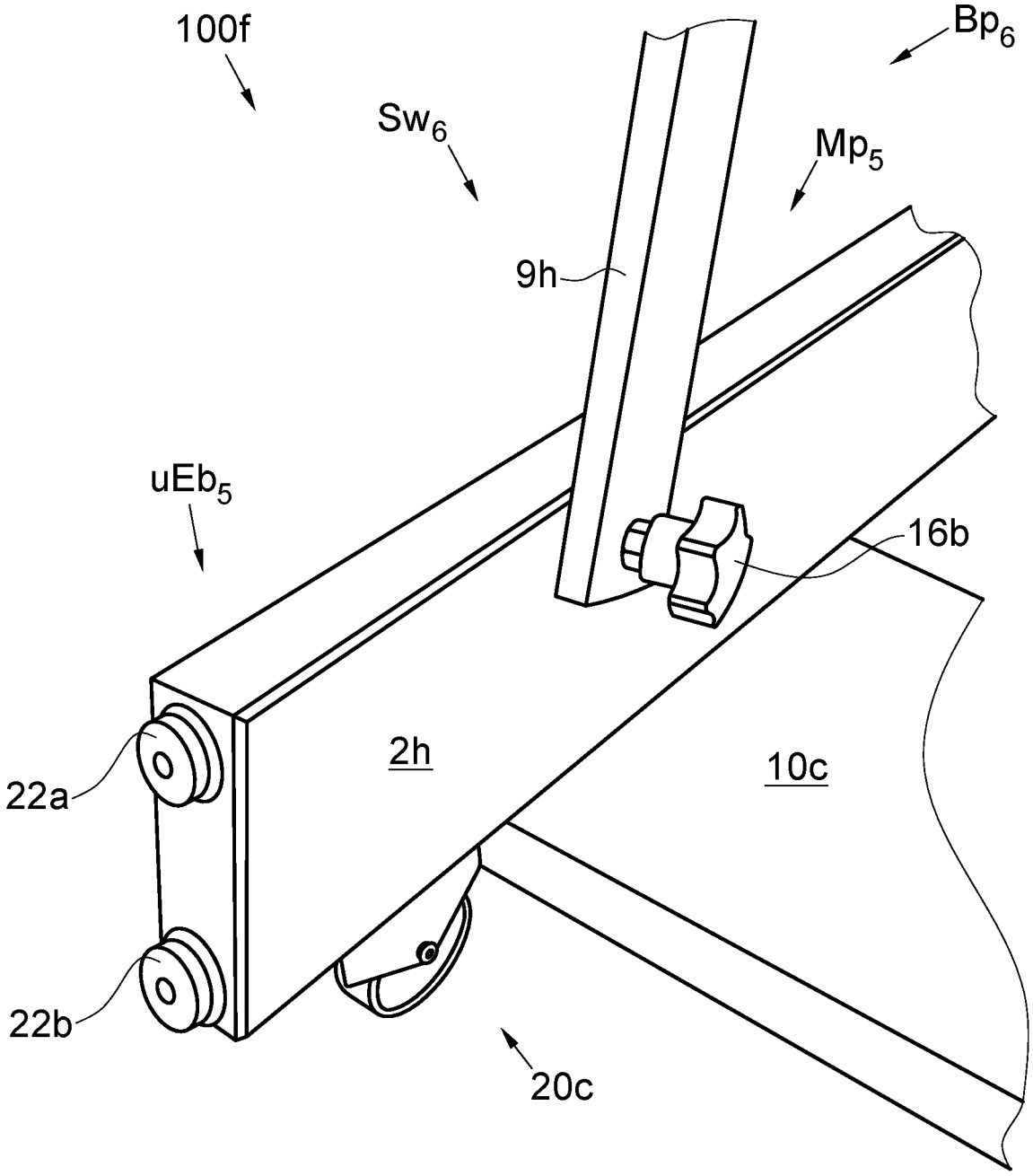
FIG. 8 a symbolic and exemplary detail view of a seventh embodiment of an universal fitness device still according to the invention, with felt gliders on the limb.

FIG. 8 shows, again only in an exemplary detail drawing, a seventh embodiment of an universal fitness device 100*f* still according to the invention, which is characterized in that felt gliders 22*a* and 22*b* are arranged in a lower end area $uEb_5$ of a rear limb 2*h*.

Apart from that, a roller 20*c* is now readily visible "in use" in that the universal fitness device 100*f* has been tilted onto its rear limbs 2*h* and virtually rests thereon. For this purpose, the diameter of the roller 20*c* preferably exceeds the final dimension of a reinforcement board or step board 10*c*. It should be imagined that, in the indicated recumbent position of the universal fitness device 100*f* as indicated herein, the front limbs still project upward at a spread angle $Sw_6$ because a fixing holder 9*h* is still screwed to a hand screw 16*b* in a mounting position $Mp_5$ and has not yet pivoted to the waiting position on the opposite front limb. In other words, the universal fitness device 100*f* is in a recumbent position but still in an operating position $Bp_6$.

Figure 9:
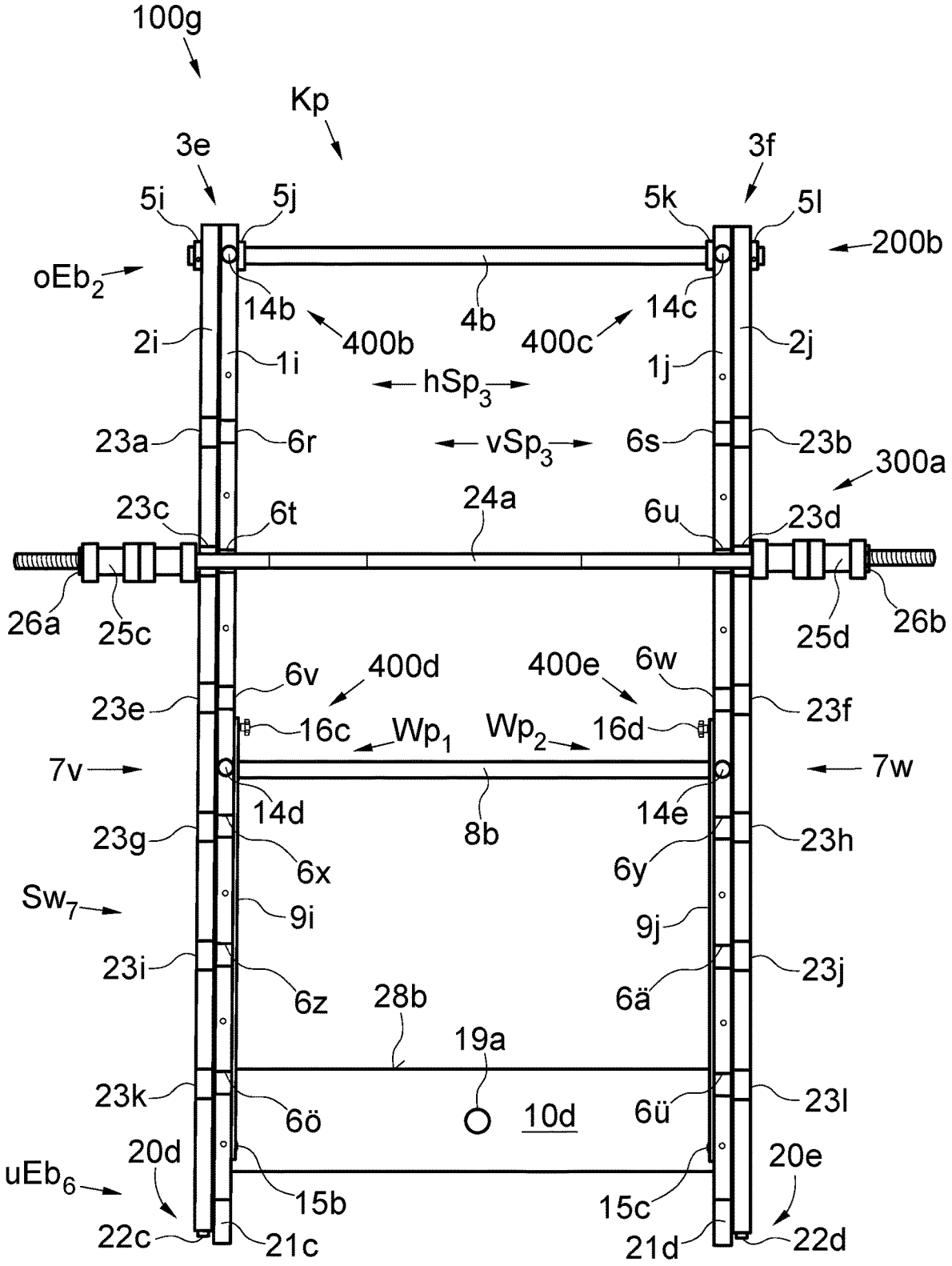
FIG. 9 a symbolic and exemplary overall view of an eighth embodiment of an universal fitness device still according to the invention, in folded position, for example represented lying in top view.

FIG. 9 shows an eighth and final embodiment of a fitness device 100*g* still according to the invention, which is represented folded and lying in a top view in a folding position Kp. Thus, not only front limbs 1*i* and 1*j*, but also rear limbs 2*i* and 2*j* are in the same plane, likewise as fixing holders 9*i* and 9*j*, which are now in respective waiting positions $Wp_1$ and $Wp_2$. A spread angle $Sw_7$, between the rear limbs 2*i* and 2*j* and the front limbs 1*i* and 1*j*, is zero.

In a lower end area $uEb_6$, flattenings 21*c* and 21*d* are now visible from the front, at the front and inner limbs 1*i* and 1*j* at their end faces. Also there, and merely indicated by curved arrows, are rollers 20*d* and 20*e* on the rear limbs 2*i* and 2*j*. An auxiliary bar 8*b* is inserted into merely indicated receptacles 7*v* and 7*w*. Otherwise, the universal fitness device 100*g* has the previously known features and thus these are merely represented consecutively numbered in this FIG. 9 without further description.

However, a still according to the invention and optional to all previous embodiments of an universal fitness device 100, 100*a*-100*f* according to the invention from the previous FIGS. 1-8, is that recesses 23*a*-23*l* are also arranged in the rear limbs 2*i* and 2*j* at the level of holders 6*r*-6*ü* in the front limbs 1*i* and 1*j*. These recesses 23*a*-23*l* result in the possibility of leaving a barbell 300*a* "supplied" in the universal fitness device 100*g* even in the folded folding position Kp of the universal fitness device 100*g*, for example in the holders 6*t* and 6*u* in which it is currently located. This is because it would be impractical if the universal fitness device 100*g* could be folded up and thus stored in a space-saving manner, but for this purpose, the barbell 300*a* had to be removed beforehand from its holders 6*t* and 6*u*, in order to be stored in another, separate location.

In the FIGS. 10A-10L, schematic and exemplary possible fitness exercises are shown, which are feasible with an universal fitness device according to the invention as disclosed in the previous FIGS. 1-9. Such fitness exercises would be, for example:

FIG. 10A shows as a first fitness exercise $Fü_1$ pull-ups, where the lower limbs can be bent, for tall people all the time;

FIG. 10B shows as a second fitness exercise $Fü_2$, a so-called front lever, where the legs can also be held still;

FIG. 10C shows as a third fitness exercise $Fü_3$ push-ups, supported on an additional bar, whereby the additional bar can be used almost at floor level, but also higher;

FIG. 10D shows as a fourth fitness exercise $Fü_4$ stepping on the top of the step board, where the top can also be horizontally oriented and wider;

FIG. 10E shows as a fifth fitness exercise $Fü_5$ pull-ups in a hanging lying position, so-called upward rowing, again on an additional bar at a variable height;

FIG. 10F shows as a sixth fitness exercise $Fü_6$ rowing, for example with a Thera-Band, which is guided through the hole in the reinforcement board or step board and where a conceivable accessory to the universal fitness device can be an integrated bench on rollers;

FIG. 10G shows as a seventh fitness exercise $Fü_7$ triceps exercises with a Thera-Band attached to the horizontal bar;

FIG. 10H shows as a eight fitness exercise $Fü_8$ dips for back, shoulders and triceps;

FIG. 10I shows as a ninth fitness exercise $Fü_9$ squats on one leg with the other leg supported by the foot on an auxiliary bar;

FIG. 10J shows as a tenth fitness exercise $Fü_{10}$ trunk bends, where the feet are hooked under an additional bar, which is inserted, for example, in the lowest position;

FIG. 10K shows as a eleventh fitness exercise $Fü_{11}$ bench press with the barbell, whereby lying on the floor under the universal fitness device according to the invention, can be done on the back, but also on an indicated integrated accessory reclining bench and FIG. 10L shows as a twelfth fitness exercise $Fü_{12}$ squats with the barbell, whereby the barbell can be placed or hooked into the holders of the front limbs of the universal fitness device at any height.

FIGS. 11A-11K schematically and exemplarily show further possible fitness exercises that are feasible with an universal fitness device as disclosed in previous FIGS. 1-10. Such fitness exercises would be, for example:

FIG. 11A shows as a thirteenth fitness exercise $Fü_{13}$ dips for the back and triceps, whereby one can support oneself on the upper side of the step board;

FIG. 11B shows as a fourteenth fitness exercise $Fü_{14}$ push-ups with legs elevated and feet supported on the top of the step board;

FIG. 11C shows as a fifteenth fitness exercise $Fü_{15}$ butt and trunk training, lying with the upper back on the floor and the feet supported by the step board;

FIG. 11D shows as a sixteenth fitness exercise $Fü_{16}$ torso training I, by lifting the legs up at an angle while hanging from the horizontal bar;

FIG. 11E shows as a seventeenth fitness exercise $Fü_{17}$ biceps curls with the barbell, where the barbell can be conveniently placed in the holders of the front limbs of the universal fitness machine;

FIG. 11F shows as a eighteenth fitness exercise $Fü_{18}$ rowing upward with the aid of the reinforcement board or step board by resting the calves on it;

FIG. 11G shows as a nineteenth fitness exercise, $Fü_{19}$ trunk training II, with the back of the knees hooked to the horizontal bar and the feet hooked to an additional bar, moving the trunk up and down;

FIG. 11H shows as a twentieth fitness exercise $Fü_{20}$ pull-ups II on the horizontal bar, with the back of the knees hooked onto an additional bar;

FIG. 11I shows as a twenty-first fitness exercise $Fü_{21}$ trunk training III, lying on the back and holding on to an additional bar;

FIG. 11J shows as a twenty-second fitness exercise $Fü_{22}$ back training I, bending over a first additional bar at hip height and supporting the heels on a second additional bar in the lowest position and FIG. 11K shows as a twenty-third fitness exercise $Fü_{23}$ back training II with accessories in the form of an integrated support box for the feet and in the form of weights.

In the FIGS. 12A-12F, further possible fitness exercises are shown schematically and by way of example, which are feasible with an universal fitness device as disclosed in the previous FIGS. 1-11. Such fitness exercises are, for example:

FIG. 12A shows as the twenty-fourth fitness exercise $Fü_{24}$ rest-ons, where the additional bar on which one rests can be used at different heights;

FIG. 12B shows the twenty-fifth fitness exercise $Fü_{25}$ head overhang on the horizontal bar;

FIG. 12C shows the twenty-sixth fitness exercise $Fü_{26}$ butt training II, supporting oneself with the hands on an additional bar, bending the legs and lifting and lowering the pelvis;

FIG. 12D shows the twenty-seventh fitness exercise $Fü_{27}$ squats II, holding onto the universal fitness machine with one hand;

FIG. 12E shows the twenty-eighth fitness exercise $Fü_{28}$ stretching I, supporting the heel of one leg on an auxiliary bar at mid-height and FIG. 12F shows the twenty-ninth fitness exercise $Fü_{29}$ stretching II, again holding onto the universal fitness machine with one hand.

REFERENCE LIST

1*a*-1*j*—front limb
2*a*-2*j*—rear limb
3*a*-3*f*—connecting joint
4, 4*a*, 4*b*—connecting bar, horizontal bar
5*a*-5*l*—positioning ring
6*a*-6*ü*—holder, recess
7*a*-7*w*—bore hole, receptacle
8, 8*a*, 8*b*—additional bar
9*a*-9*j*—fixing holder
10, 10*a*-10*d*—reinforcement board, step board
11—grub screw
12, 12*a*—radial bore hole
13, 13*a*—bolt, locking pin
14, 14*a*-14*e*—knob
15, 15*a*-15*c*—swivel joint
16, 16*a*-16*d*—hand screw
17, 17*a*-17*c*—threaded bushing
18—rubber cap
19, 19*a*—hole, fastening
20*a*-20*e*—roller
21*a*-21*d*—flattening
22*a*-22*d*—felt glider
23*a*-23*l*—recess for 300
24, 24*a*—barbell bar
25*a*-25*d*—weight or pair of weights
26, 26*a*, 26*b*—star ring

27*a*-27*d*—fitting bore hole
28, 28*a*, 28*b*—upper side from 10
100, 100*a*-100*g*—universal fitness device
200, 200*a*, 200*b*—double joint
300, 300*a*—barbell
400, 400*a*-400*e*—lock
Bp, $Bp_1$-$Bp_6$—operating position from 100
$Fü_1$-$Fü_{29}$—fitness exercise
hSp, $hSp_1$-$hSp_3$—rear pair of limbs
Kp—folding or transport position from 100
Mp, $Mp_1$-$Mp_5$—mounting position from 9
oEb, $oEb_1$, $oEb_2$—upper end area from 1 and 2
R, $R_1$—rotation from 4 or 8
S—hachure
Sw, $Sw_1$-$Sw_7$—spread angle
uEb, $uEb_1$-$uEb_6$—lower end area of 1 and 2
vSp, $vSp_1$-$vSp_3$—front pair of limbs
Wp, $Wp_1$, $Wp_2$—waiting position, stand-by position of 9

The invention claimed is:

1. A fitness device (100, 100*a*-100*g*) for performing fitness exercises ($Fü_1$-$Fü_{29}$), comprising:

two front limbs (1*a*-1*j*) and two rear limbs (2*a*-2*j*), wherein the two front limbs are respectively connected to the two rear limbs in an upper end area (oEb, $oEb_1$, $oEb_2$) by means of connecting joints (3*a*-3*f*) and by means of a connecting or horizontal bar (4, 4*a*, 4*b*);

two fixing holders (9*a*-9*j*), wherein each of the front limbs (1*a*-1*j*) is configured to be connected to the respective one of the rear limbs (2*a*-2*j*) such that a fixed operating position (Bp, $Bp_1$-$Bp_6$) of the fitness device (100, 100*a*-100*g*) with at least one predetermined spread angle (Sw, $Sw_1$-Sw7) between the front limbs (1*a*-1*j*) and the rear limbs (2*a*-2*j*) is obtained;

wherein on the two front limbs (1*a*-1*j*), receptacles (7*a*-7*w*) are arranged in a sequential order and in parallel for receiving additional bars (8, 8*a*, 8*b*) connecting the two front limbs (la-lj);

wherein the connecting joints (3*a*-3*f*) comprise positioning rings (5*a*-51) with grub screws (11) arranged on the connecting or horizontal bar (4, 4*a*, 4*b*) on both an outer and inner side of each of the respectively connected front and rear limbs (1*a*, 2*a*; 1*b*, 2*b*);

a lock (400, 400*a*-400*e*) blocking a rotation (R, $R_1$) of the connecting or horizontal bar (4, 4*a*, 4*b*) or of the additional bars (8, 8*a*, 8*b*);

wherein each of the two fixing holders (9*a*-9*j*) is pivotably arranged in a swivel joint (15, 15*a*-15*c*) on a respective one of the two front limbs (la, lb) and screwable into one of a plurality of threaded bushings (17, 17*a*-17*c*) arranged on a respective one of the two rear limbs (2*a*, 2*b*) by means of a hand screw (16, 16*a*-16*d*);

wherein the fitness device (100*g*) is collapsible from the operating position (Bp, Bpi-$Bp_6$) into a folding or transport position (Kp) in which a spread angle ($Sw_7$) between the front limbs (1*a*-1*j*) and the rear limbs (2*a*-2*j*) is zero and a thickness of the collapsed fitness device does not exceed a lateral thickness of one of the two front limbs or two rear limbs (1*a*, 1*b*, 2*a*, 2*b*).

2. The fitness device (100, 100*a*-100*g*) according to claim 1, wherein a reinforcement board or step board (10, 10*a*-10*d*) is arranged in a lower end area (uEb, $uEb_1$-$uEb_6$) of the two rear limbs (2*a*-2*j*).

3. The fitness device (100*e*, 100*g*) according to claim 2, wherein at least one fastening (19, 19*a*) for a rubber band is arranged in the reinforcement board or step board (10, 10*a*-10*d*).

4. The fitness device (100, 100*a*-100*g*) according to claim 1, wherein holders (6*a*-6*ü*) arranged in a sequential order and in parallel are arranged on the two front limbs (1*a*-1*j*).

5. The fitness device (100*g*) according to claim 4, wherein recesses (23*a*-23*l*) are arranged on the rear limbs (2*i*, 2*j*) at the same level as the holders (6*r*-6*ü*) on the front limbs (1*i*, 1*j*).

6. The fitness device (100, 100*a*-100*g*) according to claim 1, wherein the fitness device (100, 100*a*-100*g*) is made of impregnated laminated wood.

7. The fitness device (100*e*, 100*f*, 100*g*) according to claim 1, wherein at least one roller (20*a*-20*e*) is arranged in a lower end area ($uEb_4$-$uEb_6$) of the two rear limbs (2*f*-2*j*).

8. The fitness device (100*c*, 100*f*) according to claim 1, wherein replaceable feet in the form of felt gliders (22*a*-22*d*) or rubber caps (18) are arranged in a lower end area ($uEb_2$, $uEb_5$) of the front limbs (1*f*) and/or the rear limbs (2*h*-2*j*).

9. The fitness device (100*e*, 100*g*) according to claim 1, wherein a flattening (21*a*-21*d*) is arranged in a lower end area ($uEb_4$, $uEb_6$) of the front limbs (1*g*-1*j*) on a front side.

10. The fitness device (100, 100*a*-100*g*) according to claim 1, wherein the connecting joints (3*a*-3*f*) further comprise ball or roller bearings.

11. An application procedure of a fitness device (100*g*) comprising two front limbs (1*i*, 1*j*) and two rear limbs (2*i*, 2*j*) connected to each other by two connecting joints (3*e*, 3*f*) and a connecting or horizontal bar (4*b*), and two fixing holders (9*i*, 9*j*), wherein the application procedure comprises the steps of:

a) lifting and rolling the fitness device (100*g*) from a storage place to an installation place;
b) releasing each of the fixing holders (9*i*, 9*j*) from a waiting or stand-by position (Wpi, Wp2);
c) moving a first front limb (1*i*) of the two front limbs (1*i*, 1*j*) from a folding or transport position (Kp) to an operating position;
d) fixing the first front limb (1*i*) by means of a first fixing holder (9*i*) of the two fixing holders (9*i*, 9*j*);
e) moving a second front limb (1*j*) of the two front limbs (1*i*, 1*j*) from a folding or transport position (Kp) to an operating position;
f) fixing the second front limb (1*j*) by means of a second fixing holder (9*j*) of the two fixing holders (9*i*, 9*j*);
g) lifting up and setting up the fitness device (100*g*);
h) hanging or placing a barbell (300*a*) in two parallel holders (6*t*, 6*u*) respectively located in the two front limbs (1*i*, 1*j*);
i) inserting one or more additional bars (8*b*) into two parallel receptacles (7*v*, 7*w*) respectively located in the two front limbs (1*i*, 1*j*);
j) locking the one or more additional bars (8*a*, 8*b*) against rotation ($R_1$);
k) locking the connecting or horizontal bar (4*a*) against rotation (R);
l) performing at least one fitness exercise ($Fü_1$-$Fü_{29}$);
m) finishing the at least one fitness exercise;
n) removing the barbell (300*a*) from the two parallel holders (6*t*, 6*u*);
o) unlocking the connecting or horizontal bar (4*b*);
p) unlocking the one or more additional bars (8*a*, 8*b*);
q) removing the one or more additional bars (8*a*, 8*b*) from the two parallel receptacles (7*v*, 7*w*);
r) loosening the first fixing holder (9*i*) from the first front limb (1*i*);
s) fixing of the first fixing holder (9*i*) in the wait position or stand-by position ($Wp_1$);

t) loosening the second fixing holder (9*j*) from the second front limb (1*j*);

u) fixing the second fixing holder (9*j*) in the wait position or stand-by position ($Wp_2$);

v) gripping the connecting or horizontal bar (4*b*) and tilting the fitness device (100*g*), the front limbs (1*i*, 1*j*) thereby folding by themselves into the folding or transport position (Kp), moving the fitness device (100*g*) from an erected operating position into a position lying on the rear limbs via rollers (20*d*, 20*e*) on the rear limbs (2*i*, 2*j*); and w) lifting up and rolling away the fitness device (100*g*) from the installation place to the storage place.

* * * * *